US006188033B1

(12) United States Patent
Bentley et al.

(10) Patent No.: US 6,188,033 B1
(45) Date of Patent: Feb. 13, 2001

(54) SNAP-ACTING ELECTRICAL SWITCH

(75) Inventors: William J. Bentley, Cumberland, RI (US); Peter G. Berg, Attleboro Falls; David A. Koczwara, Bussards Bay, both of MA (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/479,082

(22) Filed: Jan. 7, 2000

Related U.S. Application Data

(60) Provisional application No. 60/123,566, filed on Mar. 10, 1999.

(51) Int. Cl.[7] ..... H01H 13/40

(52) U.S. Cl. ..... 200/468; 200/407

(58) Field of Search ..... 200/16 R–16 D, 200/402, 405, 407–409, 443, 445, 449, 451, 453, 456, 458–463, 467, 468

(56) References Cited

U.S. PATENT DOCUMENTS

| | | | | |
|---|---|---|---|---|
| 2,777,032 | | 1/1957 | Burch et al. | 200/113 |
| 3,105,886 | | 10/1963 | Burch et al. | 200/67 |
| 4,159,563 | * | 7/1979 | Bauer et al. | 29/622 |
| 4,168,412 | * | 9/1979 | Smith | 200/67 D |
| 4,214,136 | * | 7/1980 | Rossi et al. | 200/67 DA |
| 4,224,488 | * | 9/1980 | Rossi | 200/67 A |
| 4,278,855 | * | 7/1981 | Rossi | 200/67 D |
| 4,941,254 | * | 7/1990 | Davis | 29/622 |
| 5,617,946 | * | 4/1997 | Acampora et al. | 200/407 |

* cited by examiner

*Primary Examiner*—Michael Friedhofer
(74) *Attorney, Agent, or Firm*—Russell E. Baumann; Frederick J. Telecky, Jr.

(57) ABSTRACT

A switching element (40, 40') for use in a snap-acting electrical switch (10) has a pair of outer legs (40*a,* 40*b;* 40*a',* 40*b'*) and a center leg (40*c*) extending in substantially the same direction from a junction portion. The outer legs have a semi-annular band portion which blend together at the junction portion and a center leg at one end of the band portion. A mounting portion extends from the other end of the semi-annular band portion and is provided with mounting apertures (40*k,* 40*l*) for placement on mounting posts (18, 20) in a warped, stressed condition. A strengthening portion (40*n,* 40*r*) is formed in each semi-annular band portion, preferably along the outer portion thereof, i.e., the outer portion being away from the junction portion. An electrical contact (32) is mounted on the distal free end of the center leg for snap-movement between a pair of stationary electrical contacts (28*b,* 30*b*).

4 Claims, 2 Drawing Sheets

SNAP-ACTING ELECTRICAL SWITCH

This application claims priority under 35 USC § 119(e) (1) of provisional application Ser. No. 60/123,566 filed Mar. 10, 1999.

FIELD OF THE INVENTION

This invention relates generally to electrical switches and more particularly to snap-acting switches of the over-centering kind and such switches which can be made in small size.

BACKGROUND OF THE INVENTION

Snap-acting electrical switches having a switching element of the type disclosed in U.S. Pat. Nos. 2,777,032 and 3,105,886, the details of which are incorporated herein by this reference, have been successfully built for many years and are still in wide use. Such switching elements comprise a blade of a flat resilient material having a pair of outer legs and a center leg extending essentially in the same direction from a junction portion. The free ends of the outer legs are connected to a support by a pair of connections which are spaced from one another such that the outer legs are distorted or warped toward one another, thus urging the center leg toward a position of relative equilibrium into electrical engagement with a first stationary electrical contact thereby providing a pair of normally closed contacts. An actuating element is disposed adjacent at least one of the outer legs and is movable into engagement with one or both outer legs to bias the outer leg(s) into the opposite warped configuration away from each other thereby causing the center leg to move in the opposite direction away from the first electrical stationary contact and into engagement with a second, normally open, electrical stationary contact disposed at a location on the opposite side of a plane, passing through the support location of the outer legs, from the position of the first electrical stationary contact.

Even though the above described switches and switching elements have been very effective, it would be desirable to improve the operational performance of such switches and switching elements, for example, with regard to lowering the electrical contact resistance of the normally closed contacts and increasing the normally closed contact force.

SUMMARY OF THE INVENTION

Briefly stated, a snap-acting switch made in accordance with the invention, comprises a switching element formed of a blade of a flat, resilient material having a pair of outer legs and a center leg extending in substantially the same direction from a junction portion. The outer legs are each formed with a generally semi-annular band portion which at one end blends into the junction portion and with a mounting portion extending from the opposite end of the band portion. Although other annular configurations may be employed, a generally semicircular configuration is suitable. A mounting aperture is formed adjacent the free distal end of each outer leg for reception on a respective mounting pin as described in the above referenced patents. According to a feature of the invention, a strengthening portion is formed in the semi-annular band portion of a each outer leg, preferably on the outer portion thereof, i.e., the portion closer to the respective distal free end. In one embodiment, the strengthening portion comprises at least two permanently formed dimples or recesses, i.e., portions where the blade is deformed out of the plane of the blade, positioned generally equidistant to the inner and outer edges of the respective band portion. In another embodiment the strengthening portion is configured as a rib extending along a curved line equidistant from the inner and outer edges of the band portion. The strengthening portions stiffen an otherwise low stressed region of the outer legs in the mounted or warped condition and thereby more evenly distribute stress throughout the switching element and increase the contact force of the normally closed contact. This in turn lowers the electrical resistance of the normally closed contact and serves to increase device reliability. Additionally, the switching element made in accordance with the invention has a quicker response time and thereby reduces dead break or blackout issues.

BRIEF DESCRIPTION OF THE DRAWINGS

In the accompanying drawings in which are illustrated two embodiments of the invention.

BRIEF DESCRIPTION OF THE PREFERRED EMBODIMENTS

Figure 1:
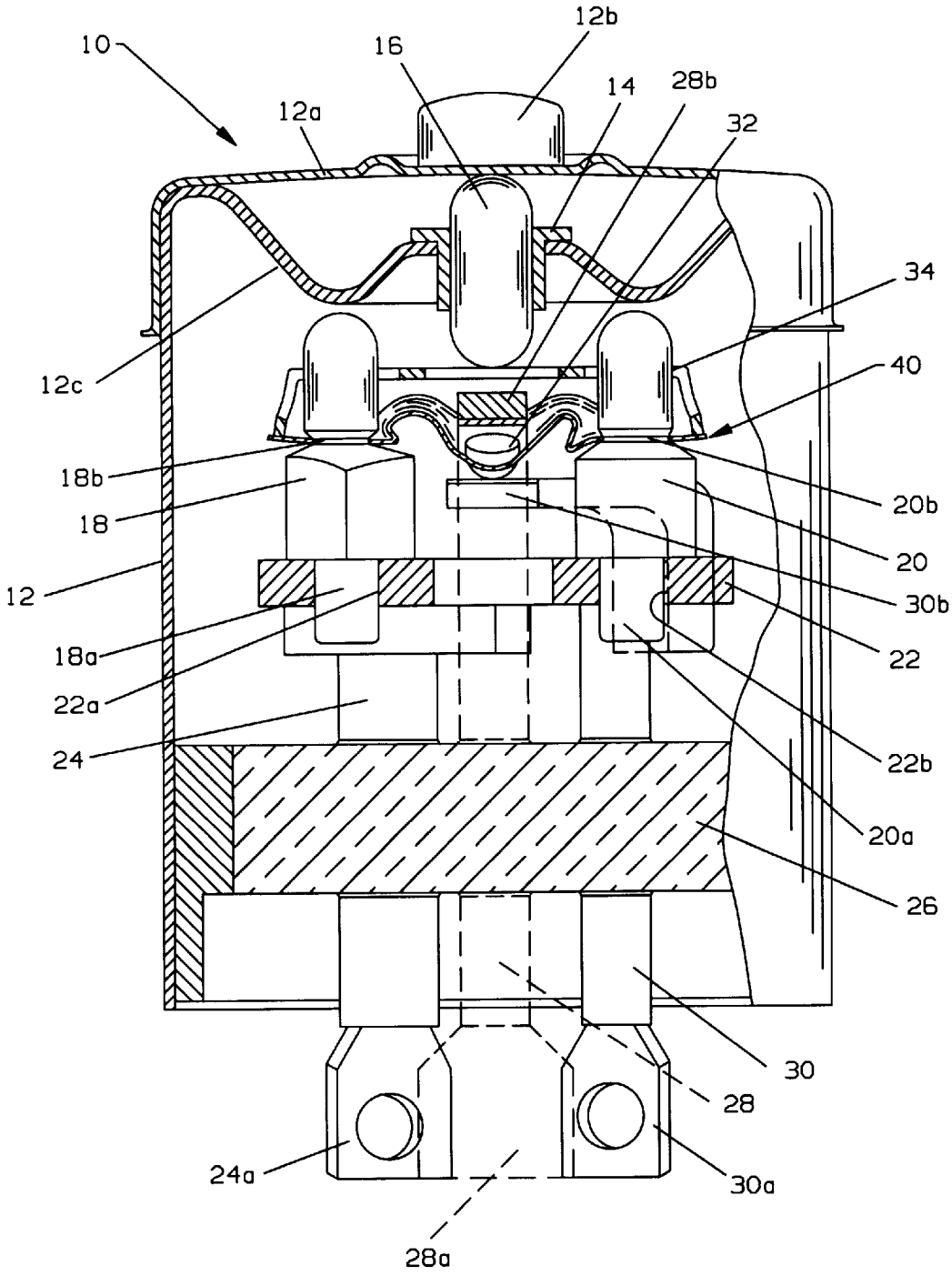
FIG. 1 is a front elevational view, partly in cross section, of an hermetically sealed switch using the switching element of either embodiment of the invention.

With reference to FIG. 1, snap-acting switch 10 made in accordance with the invention, comprises a tubular housing 12 sealed at the top by a flexible, motion transmitting diaphragm 12*a*. An actuating button 12*b* is fastened to the outside of diaphragm 12*a*. The top portion of 12*c* of housing 12 serves as a support for a guide sleeve 14 extending through an aperture formed in the support. A motion transfer pin 16 is slidably received within guide sleeve 14 to transmit motion from actuating button 12*b* to the switch mechanism to be described below.

Mounting posts 18, 20, are mounted on support plate 22 by means of respective journals 1 8*a*, 20*a*, received in bores 22*a*, 22*b*. Post 20 is firmly fixed in support plate 22 while post 18 is received in bore 22*a* with a squeeze fit so that post 18 can be rotated. Each post 18, 20 is provided with a circumferential mounting notch 18*b*, 20*b* respectively. Notch 18*b* is eccentric relative to journal 18*a* so that rotating post 18 will move notch 18*b* thereby changing the spacing between notches 18*b*, 20*b*. Support plate 22 is mounted on a current carrying stud 24 which extends through electrically insulative base 26 formed of suitable material such as glass and is provided at its free distal end with a terminal configuration 24*a*. A second electrically conductive stud 28 also extends through electrically insulative base 26 electrically isolated from stud 24 and at its inner end has a bent over contact arm 28*b* whose lower surface carries a stationary top electrical contact. The opposite end of stud 28 is formed into a terminal configuration 28*a*. A third electrically conductive stud 30 extends through base 26 electrically isolated from studs 24, 28 and at its inner end carries a bent over bottom contact arm 30*b*, the top surface of which carries a bottom stationary electrical contact. The opposite end of stud 30 is formed into a terminal configuration 30*a*. Other glass to metal seal configurations for studs 24, 28 and 30 with base 26 can be used as are known in the art to provide a hermetic device, With particular reference to FIG. 2, switching element 40 is formed of suitable flat, resilient electrically conductive material with a pair of outer legs 40*a*,

40*b* and a center leg 40*c* therebetween all spaced apart but joined together at one end. Legs 40*a* and 40*b* are each formed with a curved, generally semi-annular band portion 40*d*, 40*e*, respectively which at one end each blends into center leg 40*c* at 40*f*, 40*g* respectively. The inner and outer configuration of semi-annular band portions 40*d*, 40*e* are shown as portions of circles; however, other curved configurations could be employed, if desired. The other end of semi-annular band portions 40*d*, 40*e* extend along a generally straight line to a distal free end at 40*h*, 40*i*, respectively. A respective mounting aperture 40*k*, 40*l* is formed in the distal free end 40*h*, 40*l*, to be discussed below. Center leg 40*c* is formed with an electrical contact mounting portion, in the example being discussed, aperture 40*m*. Suitable electrical contact means 32 of FIG. 1, preferably with a contact surface on both face surfaces of switching element 40, is mounted at mounting portion 40*m* as seen in FIG. 1 by conventional means.

Switching element 40 is mounted on posts 18, 20, by forcing the free ends of the outer legs 40*a*, 40*b* toward each other until the mounting apertures 40*k*, 40*l* are in alignment with the outer distal end of the respective mounting posts. The switching element is then placed on the mounting posts with the outer legs received in respective notches 18*b*, 20*b*. The effect of forcing these free ends together is to warp the switching element until the center leg 40*c* moves downwardly as seen in FIG. 1 to bring electrical contact 32 mounted at aperture 40*m* on center leg 40*c* into engagement with the stationary bottom contact 30*b*. In that position, electrical current flows from terminal 24*a* to stud 24, support plate 22, mounting posts 18, 20, outer legs 40*a*, 40*b*, center leg 40*c*, the lower portion of electrical contact 32, the bottom contact and contact arm 30*b*, mounting stud 30 and terminal 30*a*.

Positioned above switching element 40 is an actuating arm 34 which is positioned to be engaged by motion transfer pin 16. Upon pushing the actuating arm 34 downwardly, the switching element 40 will be caused to warp in an opposite direction causing the center leg 40*c* to reverse its position with snap action so that the upper portion of electrical contact 32 will then engage the top stationary electrical contact on arm 28*b*. In this position, electrical current passes into the switch as described above from terminal 24*a* and out of the switch via top stationary electrical contact and contact arm 28*b*, mounting stud 28 and terminal 28*a*. According to a first embodiment of the invention, strengthening portions in the form of dimples 40n are placed in the semi-annular portions 40*d*, 40*e*, preferably on the outer portion thereof, i.e., the portion closer to the free distal end which, when the blade is mounted and stressed, is a low stress region of the blade. Two dimples are shown in each leg, however, the particular number can be varied, as desired. The dimples are portions permanently deformed out of the plane in which the leg lies and are preferably situated generally equidistant to the outer and inner edges of the band portion. Dimples 40*n* stiffen the otherwise low stress region to provide a more evenly distributed blade stress state which results in increased normally closed contact forces with concomitant reduced levels of electrical contact resistance and increased reliability. Additionally, due to the dimples, the response time of the blade upon actuation is quicker thereby reducing dead break or blackout issues and double snap occurrences. The enhanced performance of blade 40 allows for an easier set-up and reduces the time required for manufacture. The specific location, size, depth and shape of the dimples can be varied to affect the overall enhancement of the switching element performance.

Figure 2:
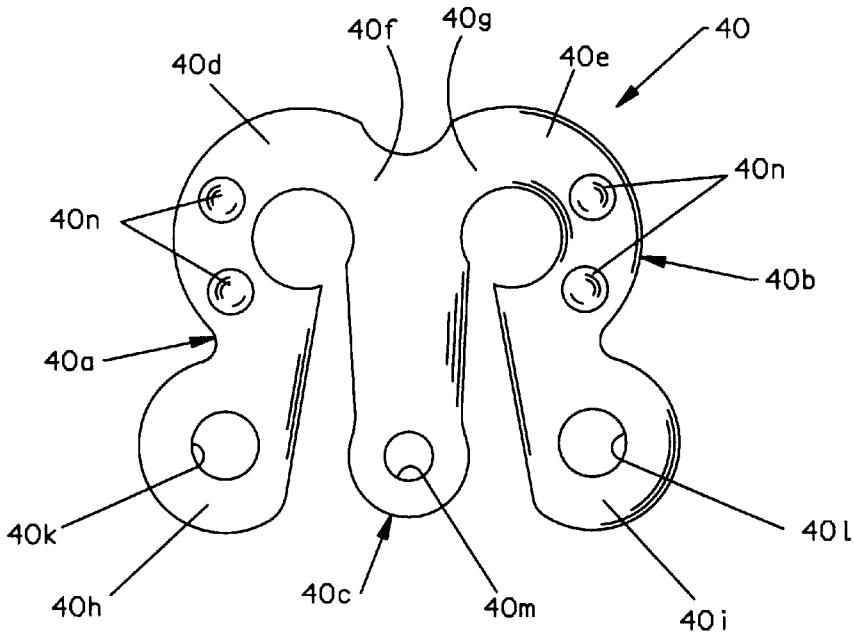
FIG. 2 is a top plan view of a switching element, in the unstressed, unmounted condition, made in accordance with a first embodiment of the invention.
Figure 3:
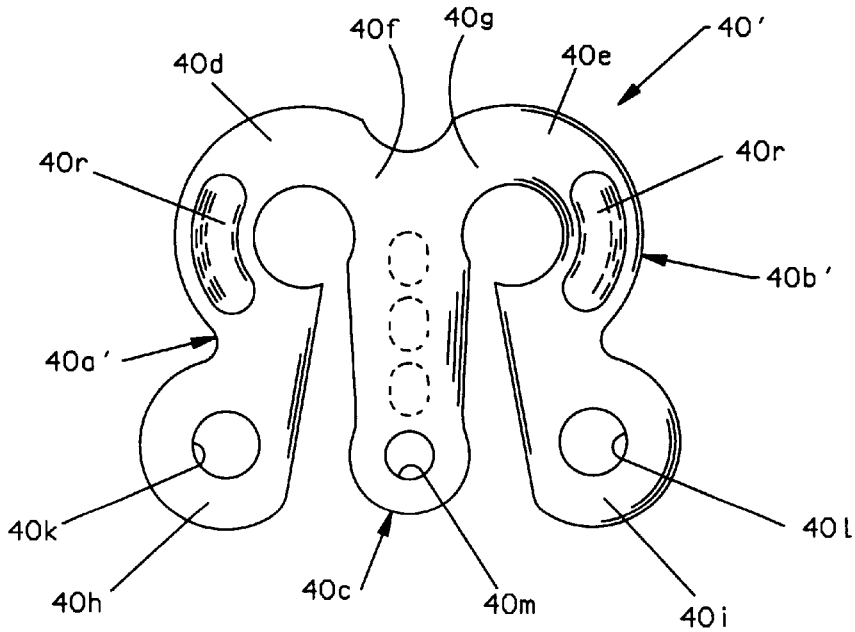
FIG. 3 is a top plan view of a switching element, also in the unstressed, unmounted condition, made in accordance with a second embodiment of the invention.

According to a modified preferred embodiment shown in FIG. 3, the strengthening portions formed in legs 40*a*', 40*b*' are configured as ribs 40*r* extending along a curved line such as the centerline of the semi-annular band. The remainder of switching element 40' is the same as shown in FIG. 2 as described above. Another advantage of the use of dimples and/or ribs is to pre-bias the center leg downwardly (as shown in FIG. 1) which helps to balance forces between normally open and normally closed contact positions.

In view of the above, it will be seen that the several objects of the invention are achieved including the provision of a switch having increased normally closed contact force with concomitant lower electrical contact resistance, increased switch reliability and enhanced response time upon switching. The enhanced performance of the switching blade allows for an easier set-up, better calibration control and reduced assembly time without negatively impacting other basic operational parameters such as actuation force, release force and movement differential.

Many changes could be made in the above constructions without departing from the scope of the invention, for example, the strengthening portions may be of various shapes placed at various locations of the switching element including the addition of dimples 40*s* and/or ribs in center leg 40*c* as shown in dashed lines in FIG. 3. The blade material, thickness and shape of the switching element may also be varied. Further, the switching element may be incorporated into various switch mechanisms having spaced mounts for the other legs. It will also be realized that although two stationary contacts are shown, the switching element can be used with a single stationary contact, if desired. It is intended that all matter contained in the above description, or as shown in the accompanying drawings, shall be interpreted as illustrative and not in a limiting sense.

What is claimed is:

1. A snap-acting switch comprising a support, a resilient, normally flat switching element lying along a plane having spaced apart outer legs and a center leg joined thereto atone end of a junction portion and extending therebetween, the outer legs each having a semi-annual band portion extending from the junction portion and having a mounting portion extending from the band portion to a distal free end, a portion of the semi-annular band portion being permanently deformed out of the plane to form a strengthening portion comprising at least two dimples, the center leg having a free distal end with a movable electrical contact mounted adjacent to the free distal end, a pair of mounting posts extending from the support in which one respective mounting portion of said outer legs is attached to one mounting post with the outer legs squeezed together into a first stressed condition, first and second spaced, aligned stationary electrical contacts mounted on opposite sides of the plane with the movable contact movable between the first and second stationary contacts, the movable contact normally being in electrical engagement with one of the stationary contacts, and an actuating member movable into engagement with at least one of the outer legs to bias the legs into a second, opposite stressed condition with the movable contact moving with snap action into engagement with the other stationary contact.

2. A snap-acting switch according to claim 1 in which said semi-annular band portion of the outer legs each has an inner and an outer edge and the dimples are generally equidistant from the inner and outer edge.

3. A snap-acting switch according to claim 1 in which said semi-annular band portion of the outer legs is generally semi-circular.

4. A snap-acting switch according to claim 1 further including a permanently deformed strengthening portion in said center leg.

* * * * *